United States Patent [19]

Toft et al.

[11] 4,045,894

[45] Sept. 6, 1977

[54] IRON WITH THERMOSTAT MOUNT

[75] Inventors: Kaj Toft, Monroe, Conn.; Llewellyn D. Busby, Asheboro, N.C.

[73] Assignee: General Electric Company, Bridgeport, Conn.

[21] Appl. No.: 743,680

[22] Filed: Nov. 22, 1976

[51] Int. Cl.[2] ..... D06F 75/06; D06F 75/26

[52] U.S. Cl. ..... 38/77.83

[58] Field of Search ..... 38/77.1, 77.2, 77.5, 38/77.83, 74, 75, 82, 88, 93; 219/252, 256

[56] References Cited

U.S. PATENT DOCUMENTS

| | | | |
|---|---|---|---|
| 2,384,839 | 9/1945 | Kistner | 38/77.83 |
| 2,871,588 | 2/1959 | Humphrey | 38/77.83 |
| 3,128,568 | 4/1964 | Schwartz | 38/77.83 |
| 3,287,837 | 11/1966 | Franklin | 38/77.5 |
| 3,369,103 | 2/1968 | Turner | 219/252 |

*Primary Examiner*—Patrick D. Lawson
*Attorney, Agent, or Firm*—John F. Cullen; George R. Powers; Leonard J. Platt

[57] ABSTRACT

The invention is directed to an extra capacity steam iron with a soleplate and heating means and separate forward main, and rear surge, steam generators with conventional means for selective delivery of water to the generators and heat regulating thermostat means. The improvement to this structure comprises a walled enclosure on the soleplate between the generators in the rear half of the iron adjacent the surge generator and asymmetrical about the longitudinal centerline of the iron. Within the enclosure there is a boss upstanding from the soleplate and smaller than the enclosure to provide some peripheral space between the boss and enclosure and a coverplate is disclosed over the soleplate to define steam distributing means from the generators. The enclosure extends through the coverplate and the boss extends above it. A slanted surface with a positioning groove for locating the thermostat is provided on the boss above the coverplate, the surface being parallel to the adjacent contoured outside iron surface. The thermostat fastens to the surface and a control button on the side of the iron is shaft-connected to the thermostat to form a short direct coupling between the thermostat and button. The combination ensures the thermostat responding to both main and surge steam demands for substantially uniform soleplate temperature.

4 Claims, 4 Drawing Figures

IRON WITH THERMOSTAT MOUNT

BACKGROUND OF THE INVENTION

1. Field of the Invention

The invention herein pertains to an extra capacity steam iron having its surge boiler in the rear of the iron and a thermostat mount that provides a direct connection to an adjacent contoured outside iron surface, the mounting providing accurate repetitive assembly and an accurate response for substantially uniform soleplate temperature.

2. Description of the Prior Art

Many irons, steam or dry, provide a mount for a temperature controlling thermostat, the mount generally comprising a boss or platform on the solepate which provides a heat sink for sensing temperature and a thermostat is mounted on the boss to react in response to temperature changes required by various settings. The control mechanism is normally on the flat surface below the iron handle in the area known as the saddle plate or in the handle or forward portion of the iron with suitable linkages connecting to the thermostat in a well known manner. The thermostat is generally mounted centrally or in the forward portion of the soleplate to detect the hottest part of the iron and react accordingly.

The structure described is normal in the conventional size larger household irons. Recent developments have produced lightweight, smaller, plastic irons at a lower price while retaining many of the standard features for dry, steam, and surge operations and these smaller irons have presented problems in applying the usual structure to obtain satisfactory results. A typical iron of this general type is shown in U.S. Pat. No. 3,986,282 of common assignment. The iron uses a rear surge generator and has required a revision in design from the usual larger irons simply because there is not enough room in this small lightweight iron for the usual arrangement of parts to supply the various features. Thus, the main object of the invention is to provide an iron structure that eliminates linkages and uses a direct button/thermostat coupling through the side of the iron and still achieves the necessary uniform soleplate temperature.

DESCRIPTION OF THE PREFERRED EMBODIMENT

Figure 1:
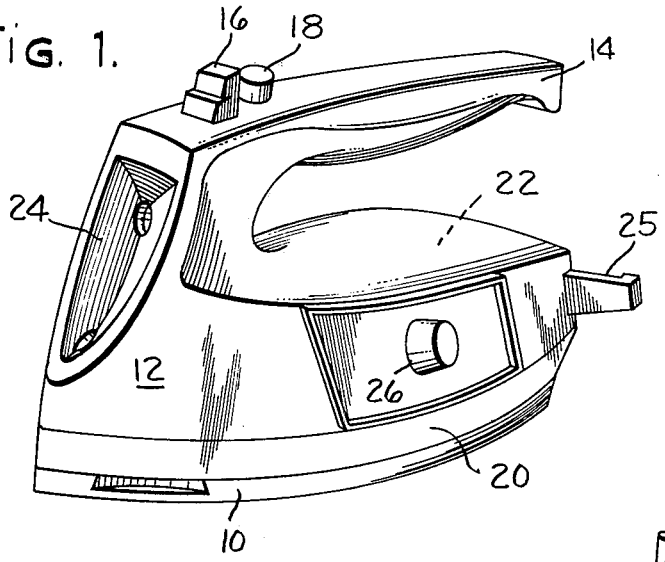
FIG. 1 is a perspective of the iron showing the thermostat control.

Referring to FIG. 1, there is shown a small lightweight plastic iron for steam and extra surge capacity having a soleplate 10 with conventional steam ports, a one-piece molded plastic contoured housing 12 formed with handle 14 and having conventional steam button 16 and extra surge button 18. A separate plastic skirt 20 is used to isolate the housing 12 from the hot soleplate 10 and an internal water tank or reservoir 22 is filled through opening 24. A stabilizing bar 25 steadies the iron in its heel rest position and may be used to wind the electrical cord not shown.

Because of the arrangement of the iron, the conventional forward thermostat or saddleplate control under handle 14 is difficult because of the water tank 22. To overcome these difficulties, a side thermostat button 26 is provided to set the desired iron temperature and provide a compact arrangement.

Figure 2:
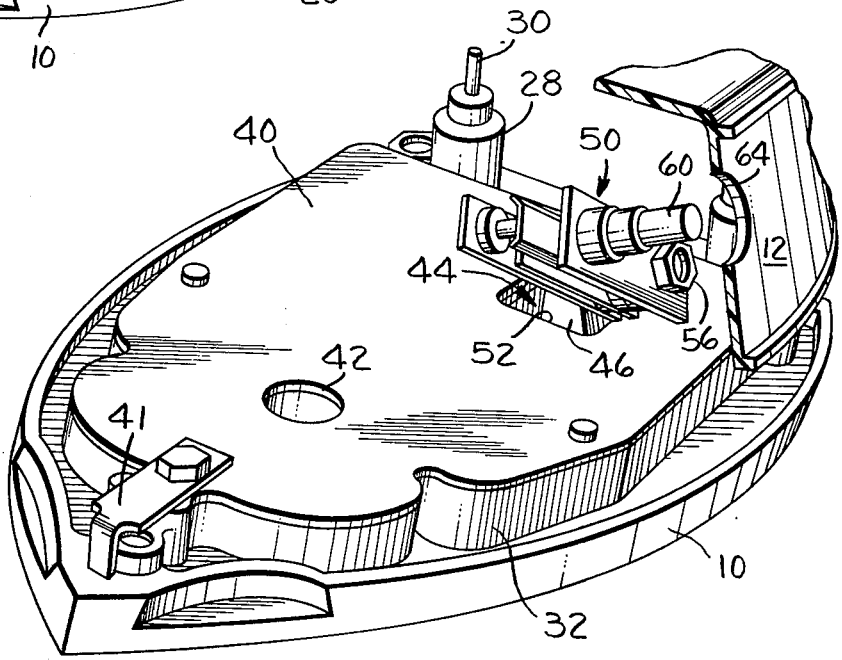
FIG. 2 is a perspective partial cut-away of the soleplate assembly showing the thermostat mount.
Figure 3:
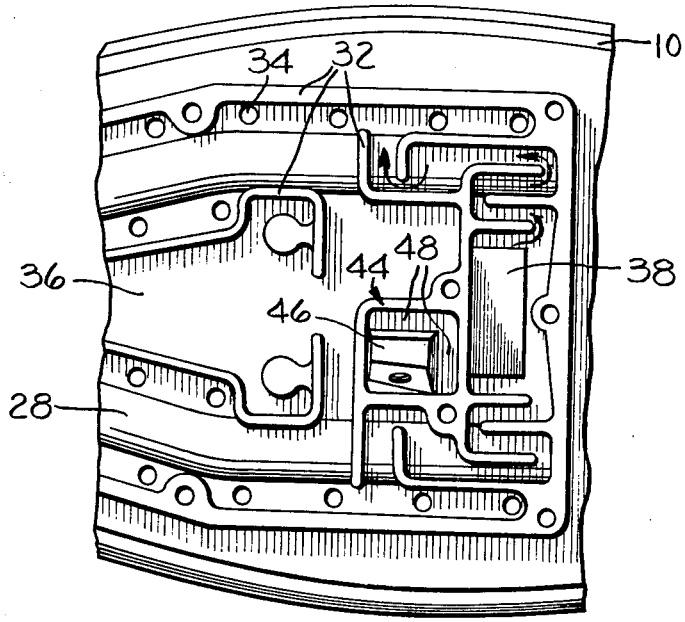
FIG. 3 is a partial plan view of the rear portion of the soleplate.

Referring to FIG. 2, the soleplate assembly is shown including aluminum soleplate 10 with, as shown in FIG. 3, its heating means 28 that may form part of the soleplate casting and comprises a conventional sheathed heating element that loops around the iron generally coming to a point at the nose and having terminal means 30 at the rear for connection to an electric source as is well known. Also forming part of the soleplate casting is a series of ribs 32 suitably formed for directing steam in a known manner out through soleplate ports 34.

To provide normal steam, a forward main generator 36 receives water drops when button 16 is in the up position as is well known. The resulting steam is directed by ribs 32 to exit ports 34. For an extra surge of steam, there is provided a rear surge generator 38 disposed in the rear half of the iron so that, if desired, water may be directed to it in the iron heel rest position to provide surge steam in the vertical position. If surge in the horizontal position is desired, rear generator 38 is supplied with an extra quantity of water to generate the necessary steam on demand, the steam following the arrows around ribs 32 for the extra surge from ports 34. Cooperating with ribs 32 and soleplate 10, there is provided a coverplate 40 which defines steam distributing means from both generators 36 and 38. Coverplate 40 has an opening 42 through which the usual water valve structure dispenses water to main generator 36 and the coverplate is sealed to ribs 32 and secured by any suitable means as bracket 41 to define the steam distributing means from the generators. Any suitable internal pump and water valve structure known in the art is connected to button 16 and 18 to selectively deliver water to the generators 36 and 38 respectively. Side thermostat control 26 sets the desired temperature as now explained.

Figure 4:
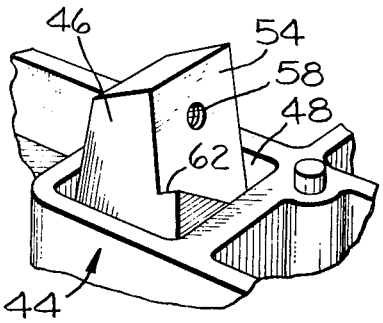
FIG. 4 is a perspective view of the thermostat mounting boss.

In order to provide a suitable thermostat arrangement in an iron of the small, lightweight size with different internal structure from the conventional iron, there is provided a walled enclosure generally indicated at 44, FIGS. 3 and 4, disposed on the soleplate between generators 36 and 38 as best seen in FIG. 3. The walled enclosure in effect, is a fenced-in area disposed in the rear half of the iron to hold and locate an upstanding integral boss 46 that is an integral part of the soleplate for good heat conduction therefrom. As seen in FIG. 4, boss 46 is smaller than the enclosure to provide a peripheral air space 48 between the enclosure and boss to provide a leveling effect for a retarding response on the thermostat generally indicated at 50 in FIG. 2. In order to accommodate the enclosure and boss, coverplate 40 has a corresponding opening 52 that fits snugly around the top of enclosure 44 so the enclosure extends substantially through the coverplate opening and is flush therewith as seen in FIG. 2. For mounting thermostat 50, boss 46 extends through the same opening in the coverplate and above it as seen in FIG. 4.

To eliminate complex linkage structure on the thermostat control in a small iron of this arrangement, the boss is provided with a slanted surface 54 above the coverplate and this surface is parallel to the adjacent contoured outside closest surface of the iron housing 12 above the skirt 20 as seen in FIGS. 1 and 2. Thermostat is then secured to slanted surface 54 by a suitable nut or bolt 56 cooperating with threaded opening 58 in the boss. This arrangement permits a short direct shaft coupling 60 between control button 26 and thermostat 50 eliminating the usual multiple linkage connection required and permitting the thermostat control to be brought out the side of the iron notwithstanding the presence of water tank 22. The entire thermostat structure 50 may be isolated by an internal pocket in housing 12 so thermostat 50 is isolated from tank 22. Also, so that the direct coupling may be kept as short as possible, the enclosure 44 is asymmetrical about the longitudinal centerline as seen in FIG. 3 being disposed closer to the button 26 side of the iron. In order for the thermostat 50 to be properly oriented and located repetitively in the same position from iron to iron during assembly, a positioning groove 62 is formed in the slanted surface 54 so thermostat 50 abuts the groove and takes a slanted and tilted position as shown in FIGS. 1 and 2 always aligning itself with housing opening 64 and control button 26.

There are several aspects to mounting boss 46 important to the proper temperature control and regulation in the iron. Its location between heating means 28 and generators 36 and 38 provides proper response from heat input to the soleplate from heating means 28 and heat removal from the steam generation so that minimal temperature variations occur on the ironing surface. In other words, there is substantially a uniform soleplate temperature at all times. Further, the peripheral air space 48 disposed between boss 46 and generators 36 and 38 and especially the long air space between the boss 46 and surge generator 38, retards and delays the response of the thermostat from rapid temperature changes when heat is rapidly removed from surge generator 38 so that heat can be drawn from other areas of the soleplate before the thermostat calls for more heat to be supplied from heating unit 28. This results in maintaining a more uniform soleplate temperature despite the location of the enclosure closely adjacent surge generator 38.

Thus, the invention provides an arrangement for a lightweight, plastic, small iron that has both main steam and surge capacity whereby all the functions of a full size iron are obtained without the complexity of the usual linkage structure. The repositioning and relocating required by the water tank 22 is obtained by a very short direct coupling from the thermostat to its side control 26. Also, the thermostat with its positioning groove locating connection to boss 46 is completely responsive to changes required by either generator 36 or 38 through heat transmitting boss 46 as protected and isolated by enclosure 44 to smooth out sudden demands from the adjacent generators while suitably responding to both. This provides a substantially uniform soleplate temperature under all conditions of operation.

While we have hereinbefore shown a preferred form of the invention, obvious equivalent variations are possible in light of the above teachings. It is therefore to be understood that, within the scope of the appended claims, the invention may be practiced otherwise than as specifically described, and the claims are intended to cover such equivalent variations.

We claim:

1. An extra capacity steam iron having a soleplate with heating means, separate forward main, and rear surge, steam generators, means selectively delivering water to the generators, and heat regulating thermostat means, the improvement comprising:

a walled enclosure on said soleplate between the generators;

a boss upstanding from the soleplate disposed in and smaller than said enclosure to provide some peripheral space therebetween;

a coverplate to define steam distributing means from the generators, the boss extending through the enclosure and above the coverplate above the coverplate;

a slanted surface on the boss above the coverplate and parallel to the adjacent contoured outside surface of the iron;

said slanted surface having a positioning groove therein for locating the thermostat repetitively;

said thermostat secured to the surface abutting said groove and;

a control button on the side of the iron connected to the thermostat;

whereby a direct coupling connects the side control button and thermostat which responds to both main and surge steam demands for a substantially uniform soleplate temperature.

2. Apparatus as described in claim 1 wherein said enclosure is disposed in the rear half of the iron adjacent the surge generator and;

the spaced boss therein is integral with the soleplate.

3. Apparatus as described in claim 2 wherein the peripheral space is disposed between the boss and generators to delay thermostat response to rapid temperature changes in said generators.

4. Apparatus as described in claim 3 wherein said enclosure is asymmetrical about the longitudinal iron centerline being disposed closer to the thermostat button control.

* * * * *